US005678376A

United States Patent [19]

Poma

[11] Patent Number: 5,678,376

[45] Date of Patent: Oct. 21, 1997

[54] UNIVERSAL INTERCEPT CLIP

[76] Inventor: James P. Poma, 160 Trumbull Ave., Girard, Ohio 44420

[21] Appl. No.: 550,001

[22] Filed: Oct. 30, 1995

[51] Int. Cl.[6] ..... E06B 1/36

[52] U.S. Cl. ..... 52/656.8; 52/314; 52/456; 52/656.5; 52/656.9; 52/713; 24/453

[58] Field of Search ..... 52/656.8, 656.9, 52/456, 314, 704, 708, 713, 656.5; 403/240, 256, 3; 24/297, 341, 453

[56] References Cited

U.S. PATENT DOCUMENTS

| | | | |
|---|---|---|---|
| 3,099,865 | 8/1963 | Burnett . | |
| 3,108,336 | 10/1963 | Tate . | |
| 3,340,661 | 9/1967 | Krieger . | |
| 3,381,431 | 5/1968 | Jacobson . | |
| 3,404,499 | 10/1968 | Lewis | 52/456 X |
| 3,504,468 | 4/1970 | Martin . | |
| 3,645,058 | 2/1972 | Jacobson et al. . | |
| 3,678,651 | 7/1972 | Hicks . | |
| 4,250,673 | 2/1981 | Hubbard . | |
| 4,285,610 | 8/1981 | Rusch | 403/256 X |
| 4,845,911 | 7/1989 | Winston et al. . | |
| 4,949,521 | 8/1990 | Riegelman et al. . | |
| 4,970,840 | 11/1990 | Quellette et al. . | |
| 4,989,384 | 2/1991 | Kinghorn et al. . | |
| 5,088,255 | 2/1992 | Emanuel . | |
| 5,088,307 | 2/1992 | Cole . | |
| 5,313,761 | 5/1994 | Leopold . | |
| 5,363,625 | 11/1994 | Philippi | 52/656.9 X |

*Primary Examiner*—Christopher T. Kent
*Attorney, Agent, or Firm*—Jones, Tullar & Cooper, P.C.

[57] ABSTRACT

A universal intercept clip connects a muntin bar to a supporting frame member of a window. The clip includes a muntin bar connecting portion, a supporting frame member connecting portion and connecting structure for removably connecting the muntin bar connecting portion to the supporting frame member connecting portion.

9 Claims, 2 Drawing Sheets

UNIVERSAL INTERCEPT CLIP

FIELD OF THE INVENTION

This invention relates generally to clips for use in window assemblies, and in particular to clips used in the assembly of muntin bars to the supporting frame members of window assemblies.

BACKGROUND OF THE INVENTION

Windows, such as those including insulated glass units, utilize clips for retaining various parts of the window in assembly. For example, in the insulated glass unit disclosed in U.S. Pat. No. 5,313,761, a clip is shown in FIGS. 9 and 10 for retaining a muntin bar to the supporting frame member of the unit. The clip includes a pair of spaced apart ledges (hooks) which engage the bottom surface of the flanges formed by the supporting frame member.

Two specific problems that one encounters in this field result from the fact that muntin bars come in many different cross sectional shapes and the size of the supporting frame members also varies. Since the subject clips are designed to accommodate both the muntin bar and the supporting frame member, this variance in the cross sectional shape of the muntin bars and the size of the supporting frame members requires a corresponding adjustment in the design of the clip. Several different muntin bar configurations are shown in U.S. Pat. Nos. 3,108,336; 3,340,661; 3,381,431; 3,504,468; 3,678,651; 4,949,521; 4,970,840; 5,088,255; and 5,088,307.

For the most part, these varying sizes and shapes require an equal variance in the design of that portion of the clip which engages with the muntin bars and the supporting frame members. This is so because the known clips are made as a single piece, preferably molded, for cost effectiveness.

Regarding the portion of the clip which engages the supporting frame member, the spaced apart ledge configuration has proven to be quite reliable. However, there is not presently on the market a clip with a universal supporting frame member engaging portion, i.e., a supporting frame engaging portion that would fit the different size supporting frame members. The different size supporting frame members give rise to different, so called, air spaces (the spacing between the free ends of the opposing flanges of the supporting frame member. See FIG. 9 of the U.S. Pat. No. 5,313,761).

It would, therefore, be desirable to have a universal type clip which could be used on more than one muntin bar and supporting frame member design.

SUMMARY OF THE INVENTION

An object of the present invention, therefore, is to advance the state of the window art, and in particular the window art that utilizes separately assembled muntin bars, by the provision of a universal clip referred to hereinafter as a universal intercept clip.

This object is achieved with the designs disclosed and suggested herein. It is believed advantageous to form the known clip into two separate parts which are joined together during assembly. One part, the muntin bar engaging part, is designed to be compatible with the various designs of muntin bar configurations. A second part of the clip (muntin bar clip portion) would be designed specifically to fit a particular supporting frame member. However, it would also be designed to accommodate all existing muntin bar clip portion designs. Preferably, the muntin bar portion of the clip would include at least one pin which extends outwardly from the muntin bar clip portion which would engage with a corresponding opening in the supporting frame member portion of the clip. The size and location of the pin and opening can be standardized so that the two parts can be sold separately.

The two parts can continue to be manufactured by molding, for example. The overall cost would be significantly reduced because of the much fewer parts that a manufacturer would have to stock. This will become clearer hereinafter.

BRIEF DESCRIPTION OF THE DRAWINGS

Five figures have been selected to illustrate a preferred embodiment of the present invention. With these figures and the accompanying text, those persons of ordinary skill in the art will be sufficiently informed so that they can practice the present invention. These figures are.

DETAILED DESCRIPTION OF THE PREFERRED EMBODIMENT

The preferred embodiment of a universal intercept clip according to the present invention will be discussed as a connector for connecting a muntin bar to a supporting frame member of an insulating glass unit of a window assembly.

Figure 1:
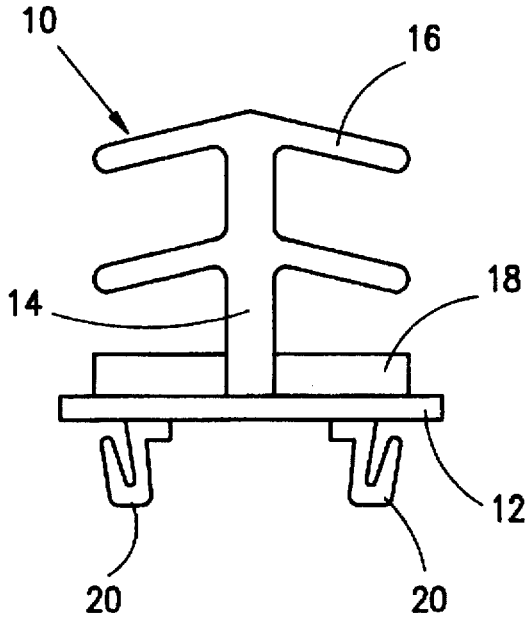
FIG. 1 (PRIOR ART)
FIG. 1 which is a front elevational view of the known clip shown in noted U.S. Pat. No. 5,313,761.
Figure 2:
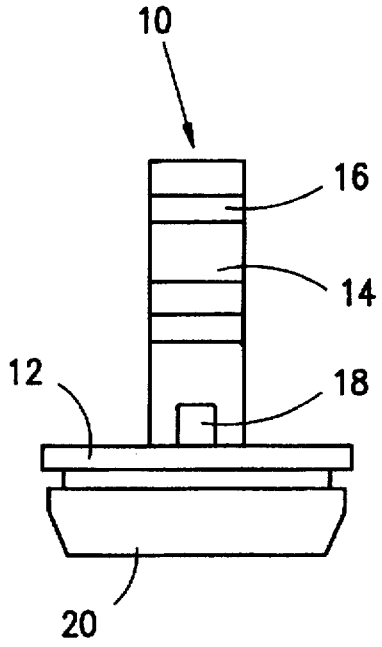
FIG. 2 (PRIOR ART)
FIG. 2 is a side elevational view of the clip shown in FIG. 1.

One configuration of this clip will, in assembly, resemble the known clip shown in FIGS. 1 and 2. The clip 10 shown in FIGS. 1 and 2 is not a universal clip in that it only connects a given muntin bar design with a supporting frame member having a given air space.

In the window art, there are many supporting frame units which are distinguished by their varying air spaces. Also, there are many muntin bar designs, as noted previously by the reference to the listed U.S. patents. So, for example, if we have 12 supporting frame designs and 12 muntin bar designs, a manufacturer of clips would have to stock 144 different design clips, since known designs are made as a single unit. This condition is significantly improved by the universal intercept clip according to the present invention, as will be seen hereinafter.

The known clip 10 (substantially according to the design shown in U.S. Pat. No. 5,313,761) includes a base plate 12, a post 14 which extends upwardly from the base plate 12 and transverse arms 16, which extend outwardly, and preferably downwardly, from the post 14. A support rib 18 lends stiffness to the clip, which is typically made of plastic and is otherwise somewhat flexible. Extending downwardly from the base plate 12 are spaced apart hooks 20 for engagement with the supporting frame member.

Figure 3:
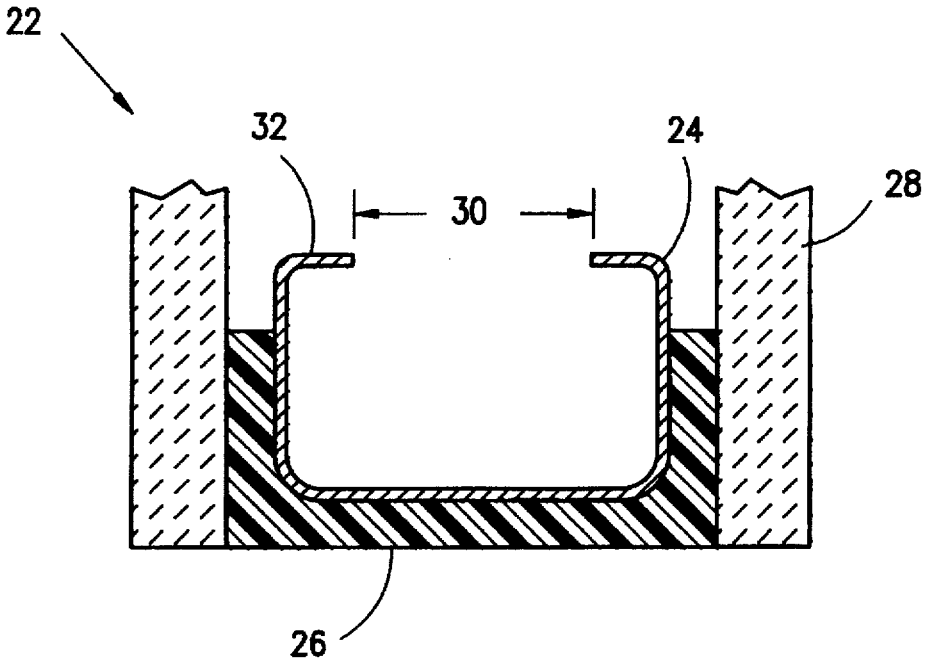
FIG. 3 (PRIOR ART)
FIG. 3 is a cross sectional view showing a supporting frame member with which the clip shown in FIGS. 1 and 2 are used and the clip of the present invention can be used.

A typical insulating glass unit 22 is shown partially in FIG. 3. The unit 22 includes a supporting frame member 24 which is connected by a sealant body 26 to glass or transparent plastic panels 28. Further details of the unit 22 can be obtained by reference to U.S. Pat. No. 5,313,761, which to this extent is incorporated by reference herein.

The supporting frame member 24 has, as shown, a generally C-shape which includes an air space 30 defined by flanges 32. It is typically this portion of the unit 22 that varies and creates the varying designs noted above, i.e., the size of the supporting frame member varies. For a given supporting frame member design the clip 10 of FIGS. 1 and 2 would have their hooks 20 spaced apart sufficiently so that they would, in assembly, engage the lower surface of the flanges 32.

Figure 4:
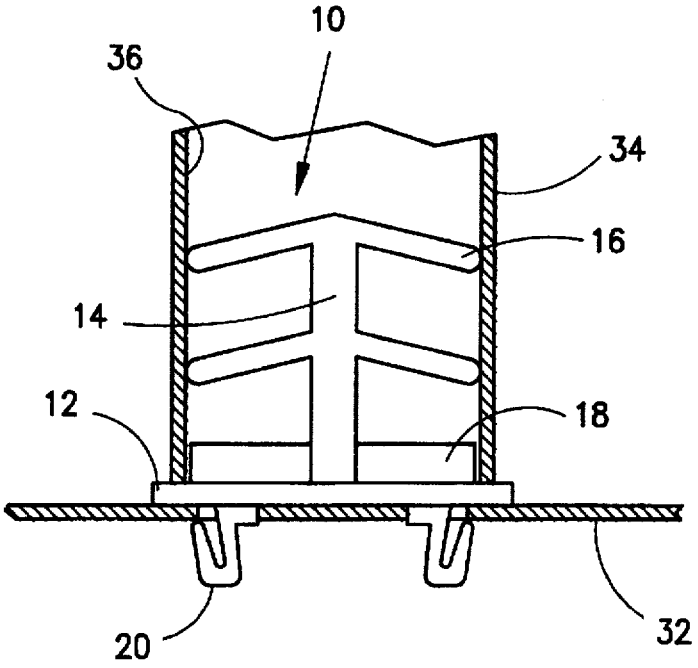
FIG. 4 shows the clip shown in FIGS. 1 and 2 in assembly with a muntin bar and the supporting frame member. The clip of the present invention would also be used in such an assembly.

The upper part of the clip 10, including the post 14, the transverse arms 16 and the rib 18, together are designed to fit into a particular muntin bar 34 as shown in FIG. 4. In assembly, the outer edges of the transverse arms 16 engage the inner surface 36 of the muntin bar 34, while the base plate 12 closes the opening of the muntin bar. FIG. 4 shows the clip 10 in assembly with the muntin bar 34 and the supporting frame member 32. The edges of the transverse arms 16 frictionally engage the inner surface 36 of the muntin bar 34, while the hooks 20 engage the lower surface of the flanges of the supporting frame member 32. With this assembly, the clip securely retains the muntin bar 34 in assembly with the supporting frame member 32.

As noted above, the clip manufacturer must produce (n)×(m) clips, i.e., the number of muntin bar designs (n) times the number of supporting frame member designs (m) if he is to meet potential demand.

Figure 5:
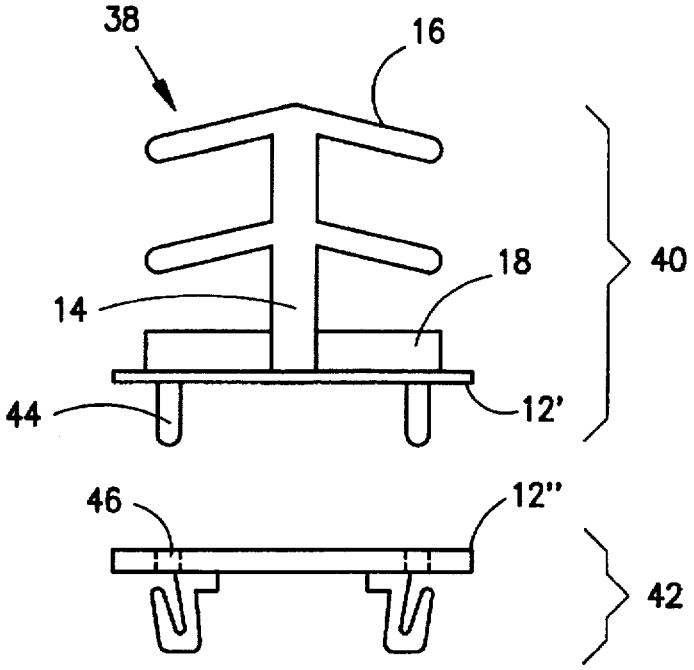
FIG. 5 is an exploded front elevational view of the universal intercept clip according to the present invention.

According to the present invention, however, the clip manufacturer need only stock (n)+(m) universal intercept clips to meet potential demand. This can be seen by reference to FIG. 5. FIG. 5 shows the universal intercept clip 38 formed as a muntin bar connecting portion 40 and a supporting frame member connecting portion 42. The portion 40 includes the post 14, transverse arms 16 and support rib 18. The base plate 12 is formed as base plate 12', from which at least one, but as shown in FIG. 5, two spaced apart pins 44 extend. The portion 42 includes a base plate 12" from which the hooks 20 extend. In addition, the base plate 12" has at least one, but as shown in FIG. 5, two equally spaced apart openings 46 for receiving the pins 42. The thickness of the base plates 12' and 12" may or may not be equal. As shown in FIG. 5, the base plate 12' is thinner than the base plate 12" because the base plate 12" must accommodate the openings 46.

In assembly the universal intercept clip 38 would connect a particular muntin bar to a particular supporting frame number, as shown in FIG. 4. With the clip 38, the clip manufacturer need provide for a lot fewer designs than he would with the known clips. Using the example noted above, the manufacturer can stock (24) universal intercept clips to accommodate the same number of muntin bar and supporting frame member designs, i.e., (12)+(12) rather than (12)×(12).

The universal intercept clip shown in FIG. 5 includes the pins in the muntin bar connecting portion 40 and the opening in the supporting frame member connecting portion 42. A reversal of this arrangement is possible with the pins being part of the supporting frame member connecting portion 42. In addition, the muntin bar connecting portion can have any one of those designs necessary to accommodate the muntin bars presently available or to be developed.

What is claimed is:

1. A universal intercept clip for connecting any of a plurality of muntin bars having differently configured cross sections to any of a plurality of supporting frame members of a window, each supporting frame member having a generally C-shaped cross section with one of a plurality of different air spaces, comprising:

a muntin bar connecting portion;

a supporting frame member connecting portion; and connecting means for removably connecting said muntin bar connecting portion to said supporting frame member connecting portion, said muntin bar connecting portion includes a base plate adapted to close the opening defined by a particular muntin bar cross section.

2. The universal intercept clip as defined in claim 1, wherein said muntin bar connecting portion further includes extension means, extending from said base plate, adapted to be received within the particular muntin bar cross section.

3. The universal intercept clip as defined in claim 1, wherein said supporting frame member connecting portion includes a base plate adapted to engage a particular supporting frame member at the air space defined by the particular supporting frame member, and extension means, extending from said base plate, adapted to engage the particular supporting frame member adjacent to the air space defined by the particular supporting frame member and serve as part of said connecting means.

4. The universal intercept clip as defined in claim 2, wherein said supporting frame member connecting portion includes a base plate adapted to engage a particular supporting frame member at the air space defined by a particular supporting frame member, and extension means, extending from said base of said supporting frame member connecting portion, adapted to engage the particular supporting frame member adjacent to the air space defined by the particular supporting frame member and serve as part of said connecting means.

5. The universal intercept clip as defined in claim 2, wherein said muntin bar connecting portion further includes at least one pin extending from the base plate of said muntin bar connecting portion in a direction opposite to that of said extension means, said at least one pin serving as part of said connecting means.

6. The universal intercept clip as defined in claim 5, wherein said supporting frame member connecting portion includes a base plate adapted to engage a particular supporting frame member at the air space defined by a particular supporting frame member, extension means, extending from the base of said supporting frame member connecting portion, adapted to engage the particular supporting frame member adjacent to the air space defined by the particular supporting frame member, and wherein said at least one opening in the base plate of said supporting frame member connecting portion for receiving said at least one pin, said extension means, at least one pin and at least one opening serving as part of said connecting means.

7. A universal intercept clip for connecting one of a plurality of muntin bars having a particular cross sectional configuration to one of a plurality of supporting frame members having a generally C-shaped cross section and a particular air space, comprising:

a muntin bar connecting portion with a base plate configured to close the particular cross sectional configuration of said one of the plurality of muntin bars, and at least one pin extending from said base plate;

a supporting frame member connecting portion with a base plate configured to engage a particular supporting frame member at the particular air space of said one of the plurality of supporting frame members, and at least one opening for receiving said at least one pin; and connecting means for connecting said muntin bar connecting portion to said supporting frame member connecting portion, said connecting means including said at least one pin and said at least one opening.

8. The universal intercept clip as defined in claim 7, wherein said supporting frame member connecting portion is provided further with extension means extending from the base of said supporting frame member connecting portion adapted to engage the particular supporting frame member adjacent to the air space defined by the particular supporting frame member.

9. The universal intercept clip as defined in claim 8, wherein two spaced apart pins extend from the base of said muntin bar connecting portion, and wherein two equally spaced apart openings are formed in the base plate of said supporting frame member connecting portion, which receive said spaced apart pins.

* * * * *